US005306589A

United States Patent [19]

Yamamoto et al.

[11] Patent Number: 5,306,589

[45] Date of Patent: Apr. 26, 1994

[54] BLACK TONER FOR COLOR DIGITAL COPYING MACHINE

[75] Inventors: Yasuo Yamamoto; Yutaka Sugizaki, both of Minami-ashigara, Japan

[73] Assignee: Fuji Xerox Co., Ltd., Tokyo, Japan

[21] Appl. No.: 881,714

[22] Filed: May 12, 1992

[30] Foreign Application Priority Data

May 14, 1991 [JP] Japan ..... 3-137046

[51] Int. Cl.[5] ..... G03G 9/08

[52] U.S. Cl. ..... 430/111; 430/106; 430/108; 430/109

[58] Field of Search ..... 430/99, 100, 106, 108, 430/109, 111, 120

[56] References Cited

U.S. PATENT DOCUMENTS

| | | | |
|---|---|---|---|
| 4,721,662 | 1/1988 | Haneda | 430/42 |
| 4,828,951 | 5/1989 | Kanedo et al. | 430/47 |
| 4,931,375 | 6/1990 | Akimoto et al. | 430/109 |
| 5,139,915 | 8/1992 | Moffat et al. | 430/110 |

*Primary Examiner*—Nathan M. Nutter
*Assistant Examiner*—Shelley A. Dodson
*Attorney, Agent, or Firm*—Oliff & Berridge

[57] ABSTRACT

A novel black toner for color digital copying machine is provided, which comprises a binder resin having dispersed therein toner particles comprising carbon black having an average primary particle diameter of 35 mμm to less than 50 mμm as a colorant in an amount of 2 to 6 parts. In a preferred embodiment, the average primary particle diameter and content of carbon black are determined such that there exist the following relationships (1) and (2) between the image density (ID) of an image developed with toner particles and the developed amount of toner (TMA) and the image density (ID) is in the range represented by the following relationship (3):

$$ID \leqq 8/3(TMA)+4/5 \quad (1)$$

$$ID \geqq 5/3(TMA)+\tfrac{1}{2} \quad (2)$$

$$1.2 \leqq ID \leqq 1.7 \quad (3)$$

wherein TMA represents the amount of toner in mg supplied per unit $cm^2$ of photoreceptor when an electrostatic latent image corresponding to a solid image is developed; and ID represents a value determined by means of a Macbeth densitometer.

8 Claims, 1 Drawing Sheet

BLACK TONER FOR COLOR DIGITAL COPYING MACHINE

FIELD OF THE INVENTION

The present invention relates to a black toner for color digital copying machine. More particularly, the present invention relates to a black toner for color digital copying machine which provides an excellent half tone reproducibility.

BACKGROUND OF THE INVENTION

In the digital copying system, the dot area ratio per pixel is changed by means of a digital copying machine to form an electrostatic latent image according to the dot area ratio, and toner particles are then attached to the electrostatic latent image to form a toner image. In this case, the amount of the toner particles to be attached to the electrostatic latent image depends on the dot area ratio. Thus, the amount of the toner attached varies with the area ratio, enabling gradation recording to be effected in response to the amount of the toner attached.

However, most conventional copying machines have employed an analog system. Accordingly, the development of toners has been intended for analog copying machines. Thus, the development of black toners for digital copying machine has been slow.

In the case where conventional black toners for analog copying machine are used for digital copying machine, when the amount of the black toner developed is changed in response to the dot area ratio, a phenomenon occurs in which the optical density of toner image doesn't vary any longer, i.e., the optical density of toner image reproduced doesn't show linear change with respect to the change in the amount of toner developed, even if the amount of toner attached exceeds a predetermined value.

The reason for this phenomenon is believed to be because that since black toners for analog copying machine which have heretofore been used comprise carbon black in toner particles in a large amount as more than 6% by weight to enhance the optical density for the purpose of optimizing the gentleness, softness and letter reproducibility of toner image, the proportion of the background to be covered by carbon black is soon saturated in the region to which a small amount of toner is attached, resulting in the saturation of the image density of the toner image thus obtained.

Then, when it is attempted to solve the foregoing problem by reducing the content of carbon black in the toner particles, another problem arises. That is, as carbon black there has heretofore been used one having a relatively small particle diameter produced by furnace process. However, the content of carbon black in a toner comprising such carbon black with a relatively small particle diameter is reduced, the region in the toner particles free of carbon black increases, making difference between the transmittance of long wavelength light and short wavelength light. The resulting developed black image exhibits a brownish red tone, making it impossible to provide an excellent black reproducibility.

SUMMARY OF THE INVENTION

It is therefore an object of the present invention to provide a black toner for digital copying machine which exhibits an excellent area gradient and a reduced toner change with the kind of light source and produces a faithful reproduction of black tone even if the carbon black content is low.

It is another object of the present invention to provide a black toner for digital copying machine which exhibits excellent tone reproduction.

These and other objects of the present invention will become more apparent from the following detailed description and examples.

As a result of extensive studies on black toner for digital copying machine, the inventors found that these problems can be solved by setting the average primary particle diameter and content of carbon black in the toner to a predetermined range. Thus, the present invention was worked out.

That is, the black toner for color digital copying machine of the present invention (hereinafter referred to as "present toner") comprises a binder resin having dispersed therein toner particles comprising carbon black having an average primary particle diameter of 35 mμm to less than 50 mμm as a colorant in an amount of 2 to 6% by weight.

In the present toner, carbon black is preferably adjusted such that its average primary particle diameter and content satisfy the following relationships (1) and (2) between the density of an image developed with the toner particles (ID) and the amount of the toner developed (TMA) and the following relationship (3) for the range of ID.

$$ID \leqq 8/3(TMA)+4/5 \quad (1)$$

$$ID \geqq 5/3(TMA)+\tfrac{1}{2} \quad (2)$$

$$1.2 \leqq ID \leqq 1.7 \quad (3)$$

wherein TMA represents the amount of toner in mg supplied per unit $cm^2$ of photoreceptor when an electrostatic latent image corresponding to a solid image is developed; and ID represents a value determined by means of a Macbeth densitometer.

BRIEF DESCRIPTION OF THE DRAWING

By way of example and to make the description more clear, reference is made to the accompanying drawing in which.

DETAILED DESCRIPTION OF THE INVENTION

Figure 1:
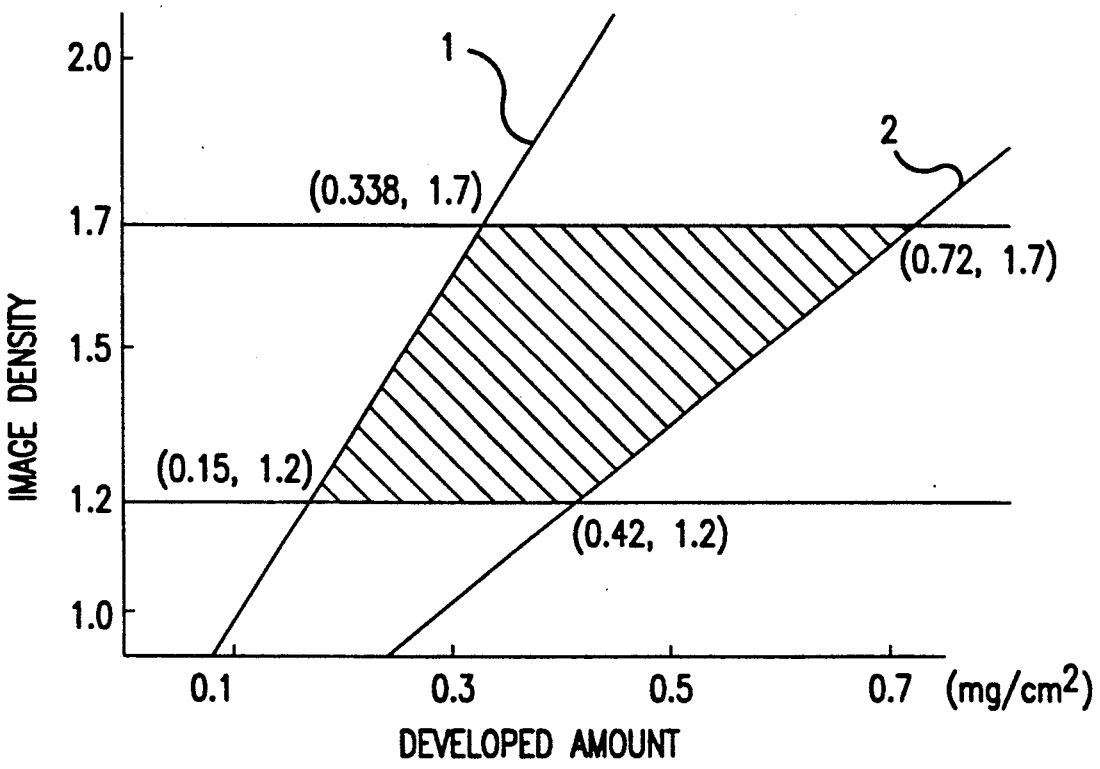
FIG. 1 a diagram illustrating the relationship between the image density and the developed amount of toner upon development wherein the reference numeral 1 represents the straight line for $ID=8/3(TMA)+4/5$, and the reference numeral 2 represents the straight line for $ID=5/3\ (TMA)+\frac{1}{2}$.

The present invention will be further described hereinafter.

Carbon black to be used in the present invention need to exhibit an average primary particle diameter of 35 mμm to less than 50 mμm as observed under an electron microscope. If the average primary particle diameter falls below 35 mμm, the color rendering properties will deteriorate. That is, if the light source is changed, the resulting color tone will change, making it impossible to provide an excellent reproduction of black tone.

On the other hand, if the average primary particle diameter exceeds 50 mμm, it will make the charge retention of toner unstable and the production of carbon black difficult.

In general, carbon black is produced by the furnace process. In this case, when it is desired to prepare carbon black having an average particle diameter of 50 mμm or more, the heating temperature must be kept low. In the furnace process, if the heating temperature is kept low, it causes a problem that impurities such as PAH (polynuclear aromatic hydrocarbons), nitropyrene and other harmful carcinogenic substances can easily remain. If the heating temperature is raised to overcome this problem, only carbon black having a small average primary particle diameter can be obtained. The above mentioned carcinogenic substances can be decomposed and eliminated by heat treatment (800° C.). However, this treatment requires a relatively high cost and thus is not practical.

In the present invention, the content of carbon black in the toner particles needs to be in the range of 2 to 6% by weight. If the content of carbon black falls below this range, the region in the toner particles free of carbon black will increase, making difference between the transmittance of long wavelength light and short wavelength light. The resulting developed black image exhibits a brownish red tone, making it impossible to provide an excellent black reproducibility. On the contrary, if the content of carbon black exceeds this range, the optical density of the toner image doesn't show a linear change, making it impossible to provide an excellent tone reproduction.

The above mentioned carbon black preferably exhibits a pH value of 7.0 to 9.0. If the pH value deviates from this range, it can easily deteriorate the environmental stability of the charged amount of the resulting toner or rapidly deteriorate the fixing roll.

The toner particles of the present invention preferably exhibits an average charged amount of 10 to 50 μC/g in absolute value, particularly 20 to 40 μC/g in absolute value to control the developed amount of toner as described below.

In the toner of the present invention, when the average primary particle diameter and content of carbon black are in the above mentioned ranges, the image density of the resulting toner image shows a linear change with the developed amount of toner and an excellent reproduction of black tone (color rendering properties) is provided, making it possible to provide an excellent gradation recording. It was experimentally found that there exists the following relationship between the primary particle diameter and content of carbon black in the toner particles and the latitude of the developed amount of toner. That is, the smaller the average primary particle diameter of carbon black particles is, and the more the content of carbon black is, the smaller is the latitude of the developed amount of toner required to provide an image density ID of 1.2 to 1.7 wherein the density change can be mostly easily perceived visually in a reproduced halftone image. On the other hand, the more the average primary particle diameter of carbon black particles is, and the less the content of carbon black is, the greater is the latitude. In other words, the small the inclination of the above mentioned straight line is, the greater is the latitude required for the desired developed amount of toner. The greater this latitude is, the more easily can be made the tone reproduction, that is, the greater is the allowance for other factors controlling the developed amount of toner.

It was thus found that in order to further secure the halftone reproducibility and thus provide an excellent gradation recording with the present toner, the average primary particle diameter and content of carbon black are preferably adjusted such that there exist the above mentioned relationships (1) and (2) between the density of an image developed with the toner particles (ID) and the amount of the toner developed (TMA) and ID is in the range represented by the above mentioned relationship (3).

The present invention will be further described with reference to these relationships in connection with the accompanying drawing. FIG. 1 is a graph illustrating the relationship between the image density and the developed amount of toner. In FIG. 1, the straight line 1 represents the case where the relationship between the image density (ID) and the developed amount of toner (TMA) is represented by the equation $ID=8/3\ (TMA)+4/5$, which case specifically corresponding to the case where toner particles containing carbon black having an average primary particle diameter of 35 mμm in an amount of 6% by weight are used (toner of Example 1). The straight line 2 represents the case where the relationship between the image density (ID) and the developed amount of toner (TMA) is represented by the equation $ID=5/3\ (TMA)+\frac{1}{2}$, which case specifically corresponding to the case where toner particles containing carbon black having an average primary particle diameter of 47 mμm in an amount of 2% by weight are used (toner of Example 2).

That is to say, in the present invention, in order to further secure an excellent gradation recording (tone reproduction), the average primary particle diameter and content of carbon black to be contained in the toner particles need to be adjusted such that the relationship between the image density and the developed amount of toner falls within the masked region A, i.e. region surrounded by the straight line 1 and the straight line 2 between image densities of 1.2 and 1.7, which can be mostly easily perceived visually.

Referring more particularly to FIG. 1, if the average primary particle diameter of carbon black falls below 35 mμm and its content exceeds 6% by weight, the latitude of the developed amount of toner required to reproduce an image density of 1.2 to 1.7 after fixing necessary for gradation recording becomes smaller. Even if the content of carbon black falls within the range of 2 to 6% by weight, a brownish red tone is developed when the average primary particle diameter falls below 35 mμm. On the other hand, if the average primary particle diameter of carbon black exceeds 50 mμm and its content falls below 2% by weight, the developed amount of toner required to reproduce an image density of 1.2 to 1.7 after fixing necessary for gradation recording is raised, making the thickness of the fixed image thicker and thus causing the transfer paper to be curled.

Examples of factors that control the developed amount of toner particles, as viewed from the copying machine side, include latent image potential of dot, developed bias value of developing roll, and distance between developing apparatus and latent image potential. Examples of factors that control the developed amount of toner particles, as viewed from the developer side, include average charged amount of toner particles, toner concentration represented by toner weight/(toner+carrier) weight in the case of two-component developer consisting of toner and carrier, and conveyed amount of toner in the case of one-component developer. Therefore, the developed amount of toner cannot be unconditionally controlled simply by controlling factors on the toner side. As demonstrated in FIG. 1, however, if the toner particles of the present invention are used, an excellent tone reproduction can be obtained when the developed amount of toner is generally in the range of 0.15 to 0.72 and the image density of a toner image transferred and fixed is in the range of 1.2 to 1.7 as determined by a Macbeth densitometer.

As the binder resin for dispersing the above mentioned carbon black therein, there can be used any known binder resin. Examples of such a binder resin include homopolymers or copolymers of styrenes such as styrene, chlorostyrene and vinylstyrene, monoolefins such as ethylene, propylene, butylene and isobutylene, vinyl esters such as vinyl acetate, vinyl propionate, vinyl benzoate and vinyl butyrate, α-methylenealiphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone. Further examples of such a binder resin include polyester, polyurethane, epoxy resin, silicone resin, polyamide, modified rosin, paraffin, and waxes.

In the present invention, a charge controlling agent (e.g., salicylic acid metal salt, metal-containing azo compound, nigrosine, quaternary ammonium salt, etc.), an offset preventing agent (e.g., low molecular weight propylene, low molecular weight polyethylene, wax, etc.), a fixing aid, and other known components may be added to the binder resin.

Further, a fluidizing agent (e.g., silica, titania, alumina, etc.), and a cleaning aid or transfer aid (e.g., finely divided polystyrene particle, finely divided polymethylmethacrylate particle, finely divided polyvinylidene fluoride particle, etc.) may be used as an additive. Particularly, hydrophobic silica having a primary particle diameter of 5 to 30 nm is preferably used.

The black toner of the present invention can be prepared by a process which comprises melt-kneading the above mentioned carbon black with a binder resin and optionally other additives by means of a Banbury mixer, kneader, continuous mixer, roll mill, extruder or the like, cooling the material, pulverizing the material by means of a jet mill, and then classifying the material. In this case, it is necessary that the toner particles be classified in such a manner that the average particle diameter of the black toner is in the range of 4 to 12 μm, preferably 5 to 10 μm. If the average particle diameter of the black toner deviates from the above mentioned range, the graininess thereof will deteriorate to give a rough touch on the image, lowering the image quality.

The present invention will be further described in the following examples, but the present invention should not be construed as being limited thereto. The term "parts" as used herein means "parts by weight".

EXAMPLE 1

| EXAMPLE 1 | |
|---|---|
| Bisphenol A type polyester resin (Tg = 65° C.; Tm = 105° C.; Mn = 3,000; Mw = 10,000) | 94 parts |
| Carbon black (Asahi #60 HMAF, produced by Asahi Carbon Co., Ltd.; primary particle diameter: 35 mμm; specific surface area: 49 $m^2/g$; pH: 7.0) | 6 parts |

These components were melt-kneaded by means of an extruder, cooled, pulverized to a particle size of about 4.0 to 12.0 μm by means of a jet type pulverizer (PJM), and then classified by a classifier (TC-25, produced by Nisshin Flour Milling Co., Ltd.) to a particle size distribution d90/d10 of 3.2 or less (as determined by a microtrack produced by Nikkiso Co., Ltd.) to obtain a black toner having a particle diameter of 7 μm.

To the black toner thus obtained was added a finely divided silica powder (R812, produced by Nippon Aerosil K.K.) in an amount of 1.5 parts based on 100 parts of toner. The materials were mixed by means of a Henschel mixer.

6 Parts of this toner were mixed with 100 parts of a silicone coat carrier having a particle diameter of 50 μm by means of a V blender for 20 minutes to obtain a developer. The charged amount of the toner was −30° C./g.

Using the above developer, an unfixed image was formed on a single side-coated paper as a copy paper by means of a digital copying machine (remodelled version of FX5800, produced by Fuji Xerox) with the developed amount of solid image adjusted to 0.15 and 0.34 $mg/cm^2$, respectively. The unfixed image formed on the copy paper was then fixed by means of a heat roll type heat fixing machine on which a silicone rubber had been wound at a heat roll temperature of 160° C., a pressure roll temperature of 160° C. and a fixing speed of 160 mm/sec. to obtain fixed images with image densities of 1.2 and 1.7 (as determined by Type RD914 Macbeth densitometer), respectively.

The specimens on which the unfixed images had been formed were then evaluated for color properties at a wavelength of 380 to 700 nm by means of a spectrophotometer (color pack system produced by Shimadzu Corporation). The color properties were measured using light source C (sunlight), light source A (incandescent lamp) and light source D65 (standard light source) as light sources. The measured color values (L*a*b*) were then evaluated by the following equations:

$$X = |\text{light source } A\ a^* - \text{light source } C\ a^*|$$

$$Y = |\text{light source } A\ b^* - \text{light source } C\ b^*|$$

wherein X represents the absolute value of the difference between a* value of light source A and a* value of light source C; Y represents the absolute value of the difference between b* value of light source A and b* value of light source C; a* and b* each represents chromaticity coordinates; and L* represents saturation. When X is 1.3 or less and Y is 0.5 or less as a result of calculation, it means that the color tone shows no change with the change in the light source, giving a good gray balance (i.e., good color rendering properties).

As a result, X and Y were 1.0 or less and 0.5 or less, respectively.

| EXAMPLE 2 | |
|---|---|
| Bisphenol A type polyester resin (Tg = 65° C.; Tm = 105° C.; Mn = 3,000; Mw = 10,000) | 98 parts |
| Carbon black (# 25, produced by Mitsubishi Kasei Corporation; primary particle diameter: 47 mμm; specific surface area: 40 $m^2/g$; pH: 8.0) | 2 parts |

A black toner having a particle diameter of 7 μm was prepared in the same manner as in Example 1. Using this black toner, fixed images were obtained in the same manner as in Example 1. When the developed amounts of solid images were 0.42 mg/cm² and 0.72 mg/cm², respectively, their image densities were 1.2 and 1.7, respectively. The color properties of these specimens were evaluated in the same manner as in Example 1. As a result, X and Y were 0.5 or less and 0.3 or less, respectively. The charged amount of the toner was −33 μC/g.

| EXAMPLE 3 | |
|---|---|
| Styrene-butyl acrylate copolymer (80/20) (Tg = 65° C.; Mn = 15,000; Mw = 35,000) | 100 parts |
| Carbon black (Asahi # 60 HMAF, produced by Asahi Carbon Co., Ltd.) (primary particle diameter: 35 mμm; specific surface area: 49 $m^2/g$; pH: 7.0) (hereinafter referred to as "Carbon Black A") | 2 parts |
| Charge controlling agent (Bontron E-88, produced by Orient Chemical) | 1.0 part |

These components were melt-kneaded by means of a Banbury mixer, cooled, pulverized to a particle size of about 4.0 to 12.0 μm by means of a jet type pulverizer (PJM), and then classified by a classifier (TC-25, produced by Nisshin Flour Milling Co., Ltd.) to a particle size distribution d90/d10 of 3.2 or less (as determined by a microtrack produced by Nikkiso Co., Ltd.) to obtain a black toner having a particle diameter of 9 μm.

To the black toner thus obtained was added a finely divided silica powder (R812, produced by Nippon Aerosil K.K.) in an amount of 1.5 parts based on 100 parts of toner. The materials were mixed by means of a Henschel mixer.

6 Parts of this toner were mixed with 100 parts of a silicone coat carrier having a particle diameter of 50 μm by means of a V blender for 20 minutes to obtain a developer.

Using this developer, an unfixed image was formed on a single side-coated paper as a copy paper by means of a copying machine (remodelled version of FX5800, produced by Fuji Xerox Co., Ltd.) with the developed amounts of solid images adjusted to 0.3 to 1.4 mg/cm². The unfixed image formed on the copy paper was then fixed by means of an off-line soft roll fuser with the heat roll temperature adjusted such that the gross thereof reached 60% or more (as determined at a 75° of light source angle and 75° of light detecting angle by means of 3GM-260 Type, produced by Murakami Color Research Laboratory) to obtain fixed images with image densities of 1.0 to 2.0 (as determined by Type RD914 Macbeth densitometer). According to sensory evaluation, these specimens were confirmed to exhibit an excellent black tone and provide excellent fixed images. In this case, when the developed amounts of solid images were 0.41 mg/cm² and 0.65 mg/cm², respectively, their image densities were 1.2 and 1.7, respectively.

The specimens on which the unfixed images had been formed were then evaluated for color properties in the same manner as in Example 1. As a result, X and Y were 1.3 or less and 0.5 or less, respectively.

EXAMPLES 4 AND 5

Black toners were prepared in the same manner as in Example 3 except that the content of carbon black was altered to 3 parts (Example 4) and 6 parts (Example 5). These black toners were then evaluated for image densities and color properties in the same manner as in Example 3. As a result, when the developed amounts of solid images were 0.35 mg/cm² and 0.55 mg/cm², respectively, their image densities were 1.2 and 1.7, respectively, and X and Y were 1.2 or less and 0.5 or less, respectively, in Example 4 and when the developed amounts of solid images were 0.23 mg/cm² and 0.36 mg/cm², respectively, their image densities were 1.2 and 1.7, respectively, and X and Y were 1.0 or less and 0.5 or less, respectively, in Example 5. Thus, these black toners exhibited an excellent gray balance.

COMPARATIVE EXAMPLE 1

A black toner was prepared in the same manner as in Example 3 except that the content of carbon black was altered to 10 parts. The black toner was then evaluated for image densities and color properties in the same manner as in Example 1. As a result, when the developed amount of solid image was 0.30 mg/cm², the image density was 1.7 and the developed amount at the image density of 1.2 was unmeasurable. Further, X and Y were 0.8 or less and 0.5 or less, respectively, and thus, the black toner exhibited an excellent gray balance.

COMPARATIVE EXAMPLE 2

A black toner was prepared in the same manner as in Example 3 except that Carbon Black A was replaced by carbon black (MA8, produced by Mitsubishi Kasei Corporation; primary particle diameter: 24 mμm; specific surface area: 138 $m^2/g$; pH 2.5). This toner was then evaluated for image densities and color properties in the same manner as in Example 3. As a result, X and Y were 3.0 or less and 1.0 or less, respectively. Thus, a poor gray balance occurred.

COMPARATIVE EXAMPLES 3 TO 5

Black toners were prepared in the same manner as in Comparative Example 2 except that the content of carbon black was altered to 3 parts (Comparative Example 3), 5 parts (Comparative Example 4) and 10 parts (Comparative Example 5), respectively. These toners were then evaluated for image densities and color properties in the same manner as in Comparative Example 2. As a result, X and Y were 2.0 or less and 0.8 or less, respectively, in Comparative Example 3, 1.0 or less and 0.5 or less, respectively, in Comparative Example 4, and 0.5 or less and 0.4 or less, respectively, in Comparative Example 5. Thus, some of these specimens exhibited a poor gray balance.

In Comparative Examples 2 to 5, the developed amounts of solid images at image densities of 1.2 and 1.7, respectively were shown in Table 1 below.

TABLE 1

| | Developed amount at ID 1.2 ($mg/cm^2$) | Developed amount at ID 1.7 ($mg/cm^2$) |
|---|---|---|
| Comparative Example 2 | 0.37 | 0.68 |
| Comparative Example 3 | 0.30 | 0.50 |
| Comparative Example 4 | — | 0.24 |
| Comparative Example 5 | — | 0.20 |

COMPARATIVE EXAMPLE 6

| COMPARATIVE EXAMPLE 6 | |
|---|---|
| Bisphenol type polyester resin (Tg = 65° C.; Mn = 4,000; Mw = 10,000) | 100 parts |
| Carbon black (REGAL330, produced by Cabot; primary particle diameter: 25 mμm; specific surface area: 94 $m^2/g$; pH 8.0) | 2 parts |

These components were melt-kneaded by means of a Banbury mixer, cooled, pulverized to a particle size of about 4.0 to 12.0 μm by means of a jet type pulverizer (PJM), and then classified by a classifier (TC-25, produced by Nisshin Flour Milling Co., Ltd.) to a particle size distribution d90/d10 of 3.2 or less (as determined by a microtrack produced by Nikkiso Co., Ltd.) to obtain a black toner having a particle diameter of 9 μm.

The specimen was then evaluated for image densities and color properties in the same manner as in Example 1. As a result, X and Y were 3.0 or less and 0.9 or less, respectively. Thus, a poor gray balance occurred.

COMPARATIVE EXAMPLES 7 TO 9

Black toners were prepared in the same manner as in Comparative Example 6 except that the content of carbon black was altered to 3 parts (Comparative Example 7), 6 parts (Comparative Example 8) and 10 parts (Comparative Example 9), respectively. These black toners were then evaluated for image densities and color properties in the same manner as in Comparative Example 6. As a result, X and Y were 2.0 or less and 0.8 or less, respectively, in Comparative Example 7, 1.0 or less and 0.5 or less, respectively, in Comparative Example 8, and 0.5 or less and 0.4 or less, respectively, in Comparative Example 9. Thus, some of these black toners exhibited a poor gray balance.

In Comparative Examples 6 to 9, the developed amounts of solid images at image densities of 1.2 and 1.7, respectively were shown in Table 2 below.

TABLE 2

| | Developed amount at ID 1.2 ($mg/cm^2$) | Developed amount at ID 1.7 ($mg/cm^2$) |
|---|---|---|
| Comparative Example 6 | 0.35 | 0.65 |
| Comparative Example 7 | 0.37 | 0.52 |
| Comparative Example 8 | — | 0.26 |
| Comparative Example 9 | — | 0.23 |

EXAMPLES 6 TO 7

| EXAMPLES 6 TO 7 | |
|---|---|
| Bisphenol type polyester resin (Tg = 65° C.; Tm = 106° C.; Mn = 4,000; (Mw = 10,000) | 110 parts |
| Carbon black (# 25, produced by Mitsubishi Kasei Corporation; primary particle diameter: 47 mμm; specific surface area: 40 $m^2/g$; pH: 8.0) | 3 or 6 parts |

These components were melt-kneaded by means of an extruder, cooled, pulverized to a particle size of about 4.0 to 12.0 μm by means of a jet type pulverizer (PJM), and then classified by a classifier (TC-25, produced by Nisshin Flour Milling Co., Ltd.) to a particle size distribution d90/d10 of 3.2 or less (as determined by a microtrack produced by Nikkiso Co., Ltd.) to obtain a black toner having a particle diameter of 9 μm.

The content of carbon black was 3 parts in Example 6 and 6 parts in Example 7.

These black toners were then evaluated for image densities and color properties in the same manner as in Example 1.

As a result, X and Y were 1.2 or less and 0.5 or less, respectively, in Example 6, and 1.0 or less and 0.5 or less, respectively, in Example 7. Thus, an excellent gray balance occurred.

According to sensory evaluation, these specimens were confirmed to exhibit an excellent black tone and provide excellent fixed images.

In Examples 6 and 7, the developed amounts of solid images at image densities of 1.2 and 1.7, respectively were shown in Table 3 below.

TABLE 3

| | Developed amount at ID 1.2 ($mg/cm^2$) | Developed amount at ID 1.7 ($mg/cm^2$) |
|---|---|---|
| Example 6 | 0.38 | 0.63 |
| Example 7 | 0.20 | 0.38 |

The results of color rendering properties, density, gradation and overall judgment of image on Examples 1 to 7 and Comparative Examples 1 to 9 are set forth in Table 4.

The evaluation of these properties were made according to the following criterion:

A: Excellent
B: Slightly excellent
C: Poor

TABLE 4

| | Carbon black content (parts) | Charged amount* (μC/g) | Color rendering properties | Density | Gradation | Overall judgement of image |
|---|---|---|---|---|---|---|
| Ex. 1 | 6 | −30 | A | A | A | A |
| Ex. 2 | 2 | −33 | A | A | A | A |
| Ex. 3 | 2 | −38 | A | A | A | A |
| Ex. 4 | 3 | −27 | A | A | A | A |
| Ex. 5 | 6 | −28 | A | A | A | A |
| Ex. 6 | 3 | −35 | A | A | A | A |
| Ex. 7 | 6 | −40 | A | A | A | A |
| Comp. Ex. 1 | 10 | −20 | A | A | B | B |
| Comp. Ex. 2 | 2 | −45 | C | A | A | C |
| Comp. Ex. 3 | 3 | −40 | C | A | A | C |
| Comp. | 6 | −30 | A | A | C | C |

TABLE 4-continued

| | Carbon black content (parts) | Charged amount* (μC/g) | Color rendering properties | Density | Gradation | Overall judgement of image |
|---|---|---|---|---|---|---|
| Ex. 4 | | | | | | |
| Comp. Ex. 5 | 10 | −14 | A | A | C | C |
| Comp. Ex. 6 | 2 | −43 | C | A | A | C |
| Comp. Ex. 7 | 3 | −40 | C | A | A | C |
| Comp. Ex. 8 | 6 | −35 | A | A | C | C |
| Comp. Ex. 9 | 10 | −20 | A | A | C | C |

*: values measured at 25° C. and 45% RH

EXAMPLE 8

A black toner having an average particle diameter of 8 μm was prepared in the same manner as in Example 1 except that a bisphenol type polyester resin (Tg=62° C.; Tm=110° C.; Mn=4,000; Mw=10,000) and carbon black (Asahi # 60 HMAF, produced by Asahi Carbon Co., Ltd.; primary particle diameter: 35 mμm; specific surface area: 49 $m^2/g$; pH: 7.0) were blended in such a manner that the content of carbon black reached 3 parts.

EXAMPLE 9

A black toner having an average particle diameter of 8 μm was prepared in the same manner as in Example 1 except that a bisphenol type polyester resin (Tg=62° C.; Tm=110° C.; Mn=4,000; Mw=10,000) and carbon black (DIABLACK E(FEF), produced by Mitsubishi Kasei Corporation; primary particle diameter: 43 mμm; specific surface area: 43 $m^2/g$; pH: 8.0) were blended in such a manner that the content of carbon black reached 3 parts.

COMPARATIVE EXAMPLE 10

A black toner having an average particle diameter of 8 μm was prepared in the same manner as in Example 1 except that a bisphenol type polyester resin (Tg=62° C.; Tm=110° C.; Mn=4,000; Mw=10,000) and carbon black (REGAL 330, produced by Cabot; primary particle diameter: 25 mμm; specific surface area: 94 $m^2/g$; pH: 8.0) were blended in such a manner that the content of carbon black reached 3 parts.

COMPARATIVE EXAMPLE 11

A black toner having an average particle diameter of 8 μm was prepared in the same manner as in Example 1 except that a bisphenol type polyester resin (Tg=62° C.; Tm=110° C.; Mn=4,000; Mw=10,000) and carbon black having an average primary particle diameter of 50 mμm, a specific surface area of 35 $m^2/g$ and a pH of 8.0 were blended in such a manner that the content of carbon black reached 3 parts. X and Y were 0.8 or less and 0.5 or less, respectively. Further, the charged amount when the image defect was generated was −10 μC/g.

In Examples 8 and 9 and Comparative Examples 10 and 11, the developed amounts of solid images at image densities of 1.2 and 1.7, respectively were shown in Table 5 below.

TABLE 5

| | Developed amount at ID 1.2 ($mg/cm^2$) | Developed amount at ID 1.7 ($mg/cm^2$) |
|---|---|---|
| Example 8 | 0.37 | 0.60 |
| Example 9 | 0.34 | 0.60 |
| Comparative Example 10 | 0.35 | 0.50 |
| Comparative Example 11 | 0.32 | 0.55 |

To the black toners thus obtained in Examples 7 and 8 and Comparative Examples 9 and 10 was added a finely divided hydrophobic silica powder (R812, produced by Nippon Aerosil K.K.) in an amount of 1.5 parts based on 100 parts of toner. The materials were mixed by means of a Henschel mixer.

The results of environmental stability of charged amount, charge retention, color tone and overall judgment of image are set forth in Table 6.

The evaluation of color tone was effected in the same manner as in Table 4. The evaluation of the environmental stability of charged amount and the charge retention were effected as follows:

Environmental stability

About 25 g of a developer with a toner to carrier ratio of 6:94 was prepared from a silicone-coated ferrite carrier having a carrier diameter of 40 μm to 50 μm. The developer was then charged into a 100-ml glass reagent bottle. The developer was stirred at an elevated temperature and a high humidity (30° C./85%RH), and then the charged amount of the toner was measured. Similarly, the developer was stirred at a low temperature and a low humidity (10° C./15%RH), and the charged amount of the toner was similarly measured. The ratio of the charged amount of toner at an elevated temperature and a high humidity to that at a low temperature and a low humidity was then determined. When this ratio was ½ or more, the environmental stability of the charged amount of toner was considered excellent (rating of A). If this ratio was less than ½ and a toner with opposite polarity occurred, the environmental stability of the charged amount of toner was considered no good (rating of B).

charge retention

Using a developer prepared from a silicone-coated ferrite carrier having a particle diameter of 40 μm to 50 μm as a carrier with T/C (tone/carrier ratio) of 8%, continuous copying was effected by means of a digital version of FX5030M/C (produced by Fuji Xerox Co., Ltd.). Running test was effected in an atmosphere of 20° C. and 40% RH. Image defects, i.e., fog on the background and image loss were then observed to judge the charge retention.

The evaluation of charge retention was effected according to the following criterion:

A: No image defects even after 50,000 continuous copies

B: No image defects even after 30,000 continuous copies

TABLE 6

| | Primary particle diameter (mμm) | Charged amount* (μC/g) | Environmental stability | Color retention | Color tone | Overall judgement of image |
|---|---|---|---|---|---|---|
| Ex. 7 | 35 | −30 | A | A | A | A |
| Ex. 8 | 45 | −30 | A | A | A | A |
| Comp. Ex. 10 | 25 | −31 | A | A | C | C |
| Comp. Ex. 11 | 50 | −30 | B | B | A | C |

*: values measured at 25° C. and 45% RH

The above mentioned black toners were analyzed for safety. That is, the specimens were dry-distillated and concentrated with a monocyclic aromatic organic solvent by means of a Soxhlet extractor for 12 hours before analysis. As a result, carbon black having a particle diameter of 50 mμm couldn't be used because it had a high impurity concentration.

The black toner for color digital copying machine of the present invention is useful for the formation of an image with an excellent area gradation, no color tone change with the change in the light source and a faithful black reproducibility.

While the invention has been described in detail and with reference to specific embodiments thereof, it will be apparent to one skilled in the art that various changes and modifications can be made therein without departing from the spirit and scope thereof.

What is claimed is:

1. A black toner for color digital copying machine, which comprises a binder resin having dispersed therein toner particles comprising carbon black having an average primary particle diameter of 35 mμm to less than 50 mμm as a colorant in an amount of 2 to 6 parts.

2. A black toner for color digital copying machine as claimed in claim 1, wherein the average primary particle diameter and content of the carbon black are determined such that there exist the following relationships (1) and (2) between the image density (ID) of an image developed with toner particles and the developed amount of toner (TMA) and the image density (ID) is in the range represented by the following relationship (3):

$$ID \leqq 8/3(TMA)+4/5 \quad (1)$$

$$ID \geqq 5/3(TMA)+\tfrac{1}{2} \quad (2)$$

$$1.2 \leqq ID \leqq 1.7 \quad (3)$$

wherein TMA represents the amount of toner in mg supplied per unit $cm^2$ of photoreceptor when an electrostatic latent image corresponding to a solid image is developed; and ID represents a value determined by means of a Macbeth densitometer.

3. A black toner for color digital copying machine as claimed in claim 1, wherein the average charged amount of said toner particles is in the range of 10 μC/g to 50 μC/g in absolute value.

4. A black toner for color digital copying machine as claimed in claim 1, wherein the average charged amount of said toner particles is in the range of 20 μC/g to 40 μC/g in absolute value.

5. An image developed with a black toner, said toner comprising a binder resin having dispersed therein toner particles comprising carbon black having an average primary particle diameter of 35 mμm to less than 50 mμm as a colorant in an amount of 2–6 parts.

6. An image according to claim 5, wherein the average primary particle diameter and content of said carbon black are determined such that there exists the following relationships (1) and (2) between the image density (ID) of said image and the developed amount of toner (TMA) and the image density (ID) is in the range represented by the following relationship (3):

$$ID \leqq 8/3(TMA)+4/5 \quad (1)$$

$$ID \geqq 5/3(TMA)+\tfrac{1}{2} \quad (2)$$

$$1.2 \leqq ID \leqq 1.7 \quad (3)$$

wherein TMA represents the amount of toner in mg supplied per unit $cm^2$ of photoreceptor when an electrostatic latent image corresponding to a solid image is developed; and ID represents a value determined by means of a Macbeth densitometer.

7. A method of forming an image in a color digital copying machine, comprising developing a latent image on a receptor with a black toner to form a developed image and transferring said developed image to a substrate, wherein said toner comprises a binder resin having dispersed therein toner particles comprising carbon black having an average primary particle diameter of 35 mμm to less than 50 mμm as a colorant in an amount of 2–6 parts.

8. A method of forming an image according to claim 7, wherein the average primary particle diameter and content of said carbon black are determined such that there exists the following relationships (1) and (2) between the image density (ID) of said image and the developed amount of toner (TMA) and the image density (ID) is in the range represented by the following relationship (3):

$$ID \leqq 8/3(TMA)+4/5 \quad (1)$$

$$ID \geqq 5/3(TMA)+\tfrac{1}{2} \quad (2)$$

$$1.2 \leqq ID \leqq 1.7 \quad (3)$$

wherein TMA represents the amount of toner in mg supplied per unit $cm^2$ of photoreceptor when an electrostatic latent image corresponding to a solid image is developed; and ID represents a value determined by means of a Macbeth densitometer.

* * * * *